US011631392B2

(12) United States Patent
Inoue et al.

(10) Patent No.: US 11,631,392 B2
(45) Date of Patent: Apr. 18, 2023

(54) ACTIVE NOISE CONTROL DEVICE

(71) Applicant: HONDA MOTOR CO., LTD., Tokyo (JP)

(72) Inventors: Toshio Inoue, Wako (JP); Xun Wang, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 17/678,964

(22) Filed: Feb. 23, 2022

(65) Prior Publication Data

US 2022/0310053 A1 Sep. 29, 2022

(30) Foreign Application Priority Data

Mar. 18, 2021 (JP) ..... JP2021-044977

(51) Int. Cl.
*G10K 11/178* (2006.01)

(52) U.S. Cl.
CPC ..... *G10K 11/17854* (2018.01); *G10K 11/17817* (2018.01); *G10K 11/17825* (2018.01); *G10K 11/17875* (2018.01); *G10K 2210/3026* (2013.01); *G10K 2210/3028* (2013.01); *G10K 2210/3044* (2013.01); *G10K 2210/3056* (2013.01)

(58) Field of Classification Search
CPC ..... G10K 11/17817; G10K 11/17825; G10K 11/17875; G10K 2210/3016; G10K 2210/3022; G10K 2210/3033
See application file for complete search history.

(56) References Cited

U.S. PATENT DOCUMENTS

2015/0172813 A1* 6/2015 Goto ..... G10K 11/17854 381/71.1

FOREIGN PATENT DOCUMENTS

EP 1 772 852 A1 4/2007
JP 2007-025527 A 2/2007

* cited by examiner

*Primary Examiner* — Kile O Blair
(74) *Attorney, Agent, or Firm* — Carrier Shende & Associates, P.C.; Joseph P. Carrier; Fulchand P. Shende

(57) ABSTRACT

An active noise control device controls a speaker so as to output a canceling sound for canceling noise transmitted from a vibration source. The active noise control device includes a control signal generating unit configured to perform signal processing on a basic signal corresponding to a predetermined frequency by a feedback filter and a extraction filter, which is an adaptive notch filter, to generate a control signal that control the speaker, a secondary path filter updating unit configured to update sequentially and adaptively a secondary path filter, and a feedback filter setting unit configured to set the feedback filter based on the secondary path filter.

6 Claims, 4 Drawing Sheets

ACTIVE NOISE CONTROL DEVICE

CROSS-REFERENCE TO RELATED APPLICATIONS

This application is based upon and claims the benefit of priority from Japanese Patent Application No. 2021-044977 filed on Mar. 18, 2021, the contents of which are incorporated herein by reference.

BACKGROUND OF THE INVENTION

Field of the Invention

The present invention relates to an active noise control device.

Description of the Related Art

JP 2007-025527 A discloses an active noise reduction device. The active noise reduction device generates a signal for controlling a speaker. Thus, an interference sound is output from the speaker. The sound pressure of noise such as road noise is reduced by the interference sound.

SUMMARY OF THE INVENTION

An active noise control device as disclosed in JP 2007-025527 A generates a control signal that controls a speaker based on a transfer characteristic between the speaker and a microphone. In the active noise control device, the transfer characteristic between the speaker and the microphone is fixed. Therefore, when the transfer characteristic changes, there are problems such that the active noise control device cannot reduce the sound pressure of the noise.

An object of the present invention is to solve the above-described problems.

According to an aspect of the present invention, an active noise control device controls a speaker based on a component of a frequency band around a predetermined frequency of an error signal output from a detector that detects, at a control point, a synthetic sound of a noise transmitted from a vibration source and a canceling sound output from the speaker to cancel the noise, and includes a basic signal generating unit configured to generate a basic signal corresponding to the predetermined frequency, a control signal generating unit configured to perform signal processing on the basic signal by a feedback filter and an extraction filter, which is an adaptive notch filter, to generate a control signal that controls the speaker, an estimated canceling sound signal generating unit configured to perform signal processing on the control signal by a secondary path filter, which is an adaptive notch filter, to generate an estimated canceling sound signal, an extraction signal generating unit configured to perform signal processing on the basic signal by the extraction filter to generate an extraction signal, a virtual error signal generating unit configured to generate a virtual error signal from the error signal and the estimated canceling sound signal, a differential signal generating unit configured to generate a differential signal from the error signal and an extraction signal, a secondary path filter updating unit configured to update sequentially and adaptively the secondary path filter based on the control signal and the virtual error signal in a manner that a magnitude of the virtual error signal is minimized, an extraction filter updating unit configured to update sequentially and adaptively the extraction filter based on the basic signal and the differential signal in a manner that a magnitude of the differential signal is minimized, and a feedback filter setting unit configured to set the feedback filter based on the secondary path filter.

The active noise control device according to the present invention can reduce noise even if the transfer characteristic changes.

The above and other objects, features, and advantages of the present invention will become more apparent from the following description when taken in conjunction with the accompanying drawings in which a preferred embodiment of the present invention is shown by way of illustrative example.

DESCRIPTION OF THE INVENTION

First Embodiment

Figure 1:
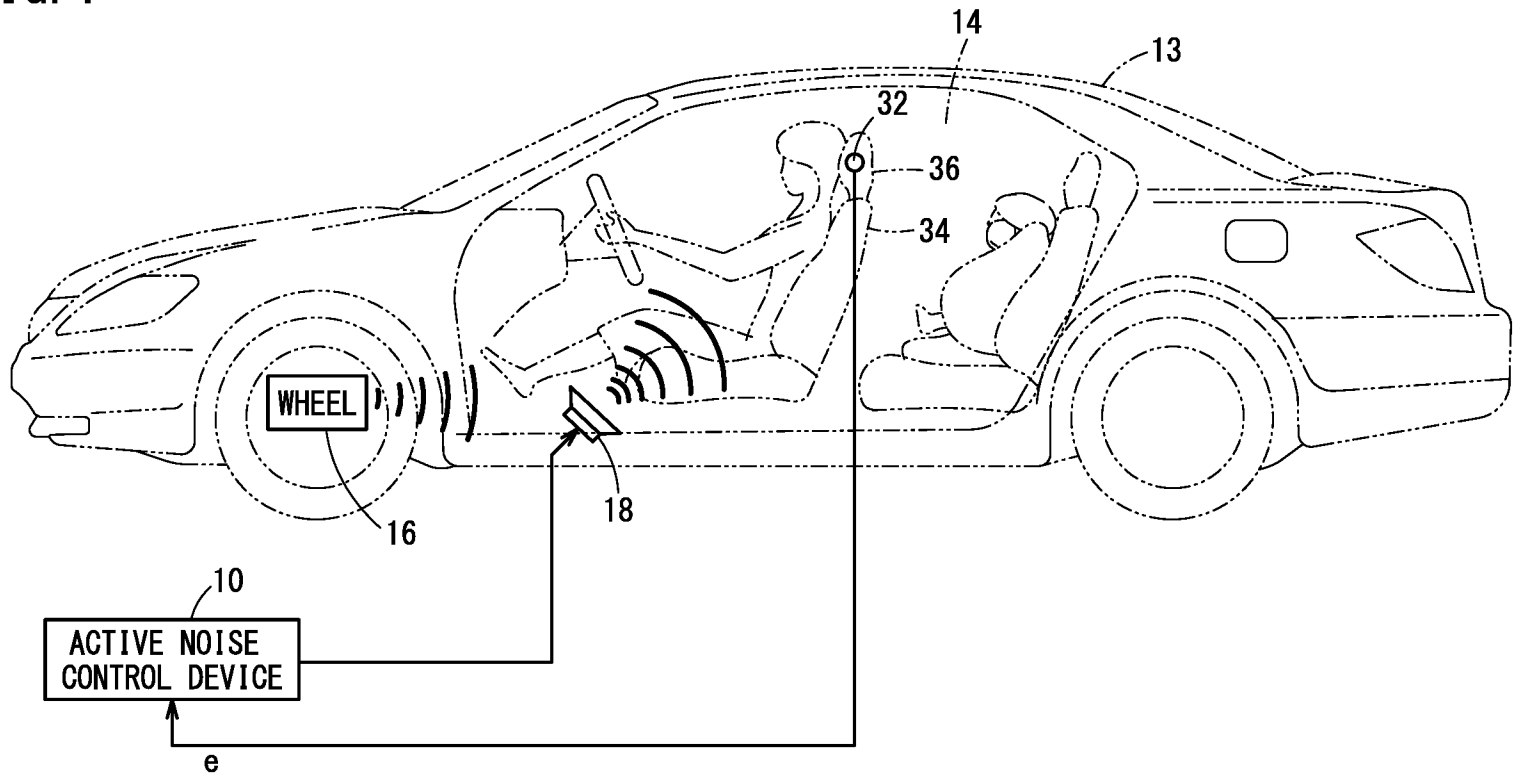
FIG. 1 is a diagram illustrating an outline of active noise control executed by an active noise control device.

FIG. 1 is a diagram illustrating an outline of active noise control executed by an active noise control device 10.

A wheel 16 is vibrated by a force received from a road surface when the vehicle travels. This vibration is transmitted to the vehicle body via the suspension, and road noise is generated in a vehicle compartment 14 of a vehicle 13. The road noise has a peak from 40 to 50 Hz. The range of frequencies from 40 to 50 Hz is a range of frequencies excited by acoustic resonance characteristics of a closed space such as the vehicle compartment 14. Narrow band components with a constant bandwidth around the peak frequency produce a roaring sound, also called drumming noise. Drumming noise is likely to cause discomfort to vehicle occupants.

The active noise control device 10 according to the present embodiment causes a speaker 18 provided in the vehicle compartment 14 to output a canceling sound. Thus, the sound pressure of the drumming noise at a control point in the vehicle compartment 14 is reduced.

Figure 2:
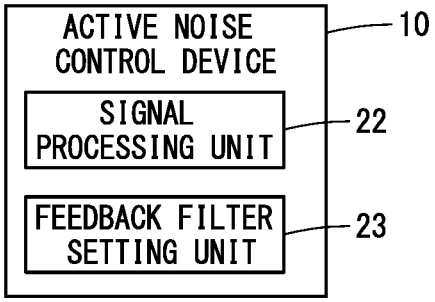
FIG. 2 is a schematic diagram illustrating a configuration of an active noise control device.

FIG. 2 is a schematic diagram illustrating a configuration of the active noise control device 10. The active noise control device 10 includes a signal processing unit 22 and a feedback filter setting unit 23.

The active noise control device 10 includes a computation unit and a storage unit (not shown). The signal processing unit 22 and the feedback filter setting unit 23 described above are realized by the computation unit.

The computation unit may be configured by a processor such as a CPU (Central Processing Unit) or a GPU (Graphics Processing Unit).

The computation unit includes a determination unit and a control unit which are not illustrated. The determination unit and the control unit are realized by the computation unit executing a program stored in the storage unit.

At least a part of the determination unit and the control unit may be realized by an integrated circuit such as an ASIC (Application Specific Integrated Circuit) or an FPGA (Field-Programmable Gate Array). In addition, at least a part of the determination unit and the control unit may be configured by an electronic circuit including a discrete device.

The storage unit can be configured by a volatile memory (not illustrated) and a nonvolatile memory (not illustrated). Examples of the volatile memory include, for example, a RAM (Random Access Memory) or the like. Examples of the nonvolatile memory include, for example, a ROM (Read Only Memory), a flash memory, or the like. Data or the like may be stored, for example, in the volatile memory. Programs, tables, maps, and the like are stored, for example, in the nonvolatile memory. At least a part of the storage unit may be provided in the processor, the integrated circuit, or the like as described above.

[Configuration of Signal Processing Unit]

Figure 3:
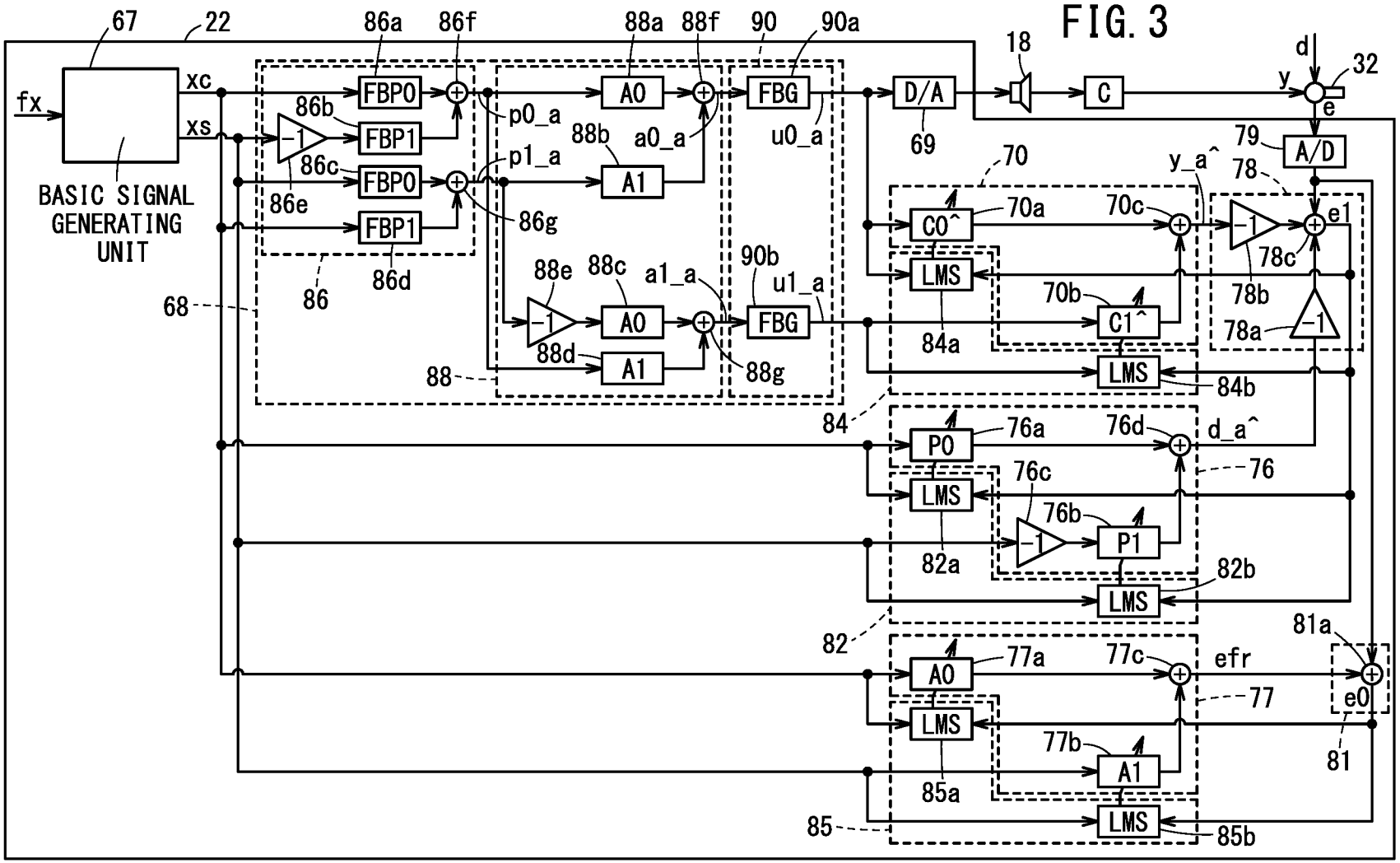
FIG. 3 is a control block diagram of a signal processing unit.

FIG. 3 is a control block diagram of the signal processing unit 22. The signal processing unit 22 performs feedback signal processing. In the feedback signal processing, a control signal u0_*a* is generated. The control signal u0_*a* is a signal for causing the speaker 18 to output a canceling sound that cancels the drumming noise. The control signal u0_*a* is generated on the basis of an error signal e output from a microphone 32 provided at the control point. Hereinafter, a sound transfer path from the speaker 18 to the microphone 32 is referred to as a secondary path, and a transfer characteristic of the secondary path is denoted by C.

In the present embodiment, the control point is near the ears of the vehicle occupant. For this purpose, as shown in FIG. 1, the microphone 32 is provided at a headrest 36 of a seat 34 in the vehicle compartment 14. The error signal e is a signal output from the microphone 32 that has detected a synthetic sound of the noise d at the control point and the canceling sound y at the control point.

The signal processing unit 22 includes a basic signal generating unit 67, a control signal generating unit 68, an estimated canceling sound signal generating unit 70, an estimated noise signal generating unit 76, an extraction signal generating unit 77, a virtual error signal generating unit 78, a differential signal generating unit 81, an adjustment filter updating unit 82, a secondary path filter updating unit 84, and an extraction filter updating unit 85.

The basic signal generating unit 67 generates a basic signal xc (=cos(2π×fx×t)) and xs (=sin(2π×fx×t)). The basic signal xc is a cosine signal of a control target frequency fx. The basic signal xs is a sine signal of the control target frequency fx. Here, t denotes time. The control target frequency fx is each set in advance to the peak frequency of the drumming noise and a frequency near the peak frequency.

The control signal generating unit 68 generates control signals u0_*a* and u1_*a*. The control signals u0_*a* and u1_*a* are generated by performing signal processing on the basic signals xc and xs by a feedback filter FB and an extraction filter A. The control signal generating unit 68 includes a phase adjusting unit 86, a signal extraction unit 88, and a gain adjusting unit 90.

The feedback filter FB is indicated by FB=FBG(FBP0+iFBP1) using a gain FBG, a filter coefficient FBP0, and a filter coefficient FBP1. Here, i denotes an imaginary number. Further, $FBP0^2+FBP1^2=1$. The feedback filter FB is set by the feedback filter setting unit 23. The setting of the feedback filter FB will be described later in detail. The extraction filter A will be described in detail together with an extraction signal generating unit 77 described later.

The phase adjusting unit 86 generates phase adjustment signals p0_*a* and p1_*a*. The phase adjustment signals p0_*a* and p1_*a* are generated by performing signal processing on the basic signals xc and xs by the phase adjustment filter FBP.

The phase adjusting unit 86 includes a first phase adjustment filter 86*a*, a second phase adjustment filter 86*b*, a third phase adjustment filter 86*c*, a fourth phase adjustment filter 86*d*, an inverting amplifier 86*e*, an adder 86*f*, and an adder 86*g*.

The first phase adjustment filter 86*a* has the filter coefficient FBP0. The second phase adjustment filter 86*b* has the filter coefficient FBP1. The third phase adjustment filter 86*c* has the filter coefficient FBP0. The fourth phase adjustment filter 86*d* has the filter coefficient FBP1.

The second phase adjustment filter 86*b* receives the basic signal −xs whose polarity has been inverted by the inverting amplifier 86*e*. The basic signal xc whose amplitude is adjusted by the first phase adjustment filter 86*a* and the basic signal −xs whose amplitude is adjusted by the second phase adjustment filter 86*b* are added by the adder 86*f*. Thus, the phase adjustment signal p0_*a* is generated.

The basic signal xs whose amplitude is adjusted by the third phase adjustment filter 86*c* and the basic signal xc whose amplitude is adjusted by the fourth phase adjustment filter 86*d* are added by the adder 86*g*. Thus, the phase adjustment signal p1_*a* is generated.

The signal extraction unit 88 performs signal processing on the phase adjustment signal p0_*a* and the phase adjustment signal p1_*a* using the extraction filter A. Thus, the extraction signals a0_*a* and a1_*a* are generated.

The signal extraction unit 88 includes a first extraction filter 88*a*, a second extraction filter 88*b*, a third extraction filter 88*c*, a fourth extraction filter 88*d*, an inverting amplifier 88*e*, an adder 88*f*, and an adder 88*g*.

The first extraction filter 88*a* has a filter coefficient A0. The second extraction filter 88*b* has a filter coefficient A1. The third extraction filter 88*c* has filter the coefficient A0. The fourth extraction filter 88*d* has the filter coefficient A1.

The phase adjustment signal p0_*a* whose amplitude has been adjusted by the first extraction filter 88*a* and the phase adjustment signal p1_*a* whose amplitude has been adjusted by the second extraction filter 88*b* are added by the adder 88*f*. Thus, the extraction signal a0_*a* is regenerated.

The phase adjustment signal −p1_*a* whose polarity is inverted by the inverting amplifier 88*e* is input to the third extraction filter 88*c*. The phase adjustment signal −p1_*a* whose amplitude is adjusted by the third extraction filter 88*c* and the phase adjustment signal p0_*a* whose amplitude is adjusted by the fourth extraction filter 88*d* are added by the adder 88*g*. Thus, an extraction signal a1_*a* is generated.

The gain adjusting unit 90 performs signal processing on the extraction signals a0_*a* and a1_*a* using the gain filters FBG. Thus, control signals u0_*a* and u1_*a* are generated.

The gain adjusting unit 90 includes a first gain adjustment filter 90*a* and a second gain adjustment filter 90*b*. The first gain adjustment filter 90*a* has the gain FBG. The second gain adjustment filter 90*b* has the gain FBG.

The amplitude of the extraction signal a0_*a* is adjusted by the first gain adjustment filter 90*a*. Thus, the control signal u0_*a* is generated. The amplitude of the extraction signal a1_*a* is adjusted by the second gain adjustment filter 90*b*. Thus, the control signal u1_*a* is generated. The control signal u0_*a* is converted into an analog signal by a digital-to-analog converter 69 and output to the speaker 18.

In the estimated canceling sound signal generating unit 70 described below, the control signal u0_*a* is used as a real component, and the control signal u1_*a* is used as an imaginary component.

The estimated canceling sound signal generating unit 70 performs signal processing on the control signals u0_*a* and u1_*a* by a secondary path filter C^. Thus, an estimated canceling sound signal y_a^ is generated.

In the estimated canceling sound signal generating unit 70, an adaptive notch filter (for example, a SAN (Single-frequency Adaptive Notch) filter) is used as the secondary path filter C^. The secondary path filter C^ is updated by the secondary path filter updating unit 84 described later. As a result, the secondary path filter C^ converges on the sound transfer characteristic C in the secondary path. The secondary path filter C^ is indicated by C^=C0^+iC1^ using filter coefficients C0^ and C1^. Here, i denotes an imaginary number.

The estimated canceling sound signal generating unit 70 includes a first secondary path filter 70*a*, a second secondary path filter 70*b*, and an adder 70*c*.

The first secondary path filter 70*a* has the filter coefficient C0^. The second secondary path filter 70*b* has the filter coefficient C1^. The control signal u0_*a* whose amplitude is adjusted by the first secondary path filter 70*a* and the control signal u1_*a* whose amplitude is adjusted by the second secondary path filter 70*b* are added by the adder 70*c*. Thus, the estimated canceling sound signal y_a^ is generated.

The estimated noise signal generating unit 76 performs signal processing on the basic signal xc and the basic signal xs by an adjustment filter P. Thus, an estimated noise signal d_a^ is generated. In the estimated noise signal generating unit 76, an adaptive notch filter (for example, a SAN filter) is used as the adjustment filter P for adjusting characteristics of the basic signal xc and the basic signal xs. The adjustment filter P is updated by the adjustment filter updating unit 82 described later. The adjustment filter P is indicated by P=P0+iP1 using a filter coefficient P0 and a filter coefficient P1. Here, i denotes an imaginary number.

The estimated noise signal generating unit 76 includes a first adjustment filter 76*a*, a second adjustment filter 76*b*, an inverting amplifier 76*c*, and an adder 76*d*. The first adjustment filter 76*a* has the filter coefficient P0. The second adjustment filter 76*b* has the filter coefficient P1.

The second adjustment filter 76*b* receives the basic signal −xs whose polarity has been inverted by the inverting amplifier 76*c*. The basic signal xc whose amplitude is adjusted by the first adjustment filter 76*a* and the basic signal −xs whose amplitude is adjusted by the second adjustment filter 76*b* are added by the adder 76*d*. Thus, the estimated noise signal d_a^ is generated.

The extraction signal generating unit 77 performs signal processing on the basic signal xc and the basic signal xs using an extraction filter A. Thus, an extraction signal efr is generated. In the extraction signal generating unit 77, an adaptive notch filter (for example, a SAN filter) is used as the extraction filter A. The extraction filter A is updated and optimized by the extraction filter updating unit 85 described later. The extraction filter A has filter coefficients A0 and A1 which match the basic signals xc and xs to the amplitude and phase of the drumming noise.

The extraction signal generating unit 77 includes a first extraction filter 77*a*, a second extraction filter 77*b*, and an adder 77*c*. The first extraction filter 77*a* has the filter coefficient A0. The second extraction filter 77*b* has the filter coefficient A1.

The basic signal xc whose amplitude is adjusted by the first extraction filter 77*a* and the basic signal xs whose amplitude is adjusted by the second extraction filter 77*b* are added by the adder 77*c*. Thus, the extraction signal efr is generated.

The virtual error signal generating unit 78 generates a virtual error signal e1 based on the error signal e, the estimated noise signal d_a^, and the estimated canceling sound signal y_a^. The virtual error signal generating unit 78 includes an inverting amplifier 78*a*, an inverting amplifier 78*b*, and an adder 78*c*.

The error signal e converted into a digital signal by an analog-to-digital converter 79, the estimated noise signal −d_a^ whose polarity is inverted by the inverting amplifier 78*a*, and the estimated canceling sound signal −y_a^ whose polarity is inverted by the inverting amplifier 78*b* is added by the adder 78*c*. Thus, the virtual error signal e1 is generated.

The differential signal generating unit 81 generates a differential signal e0 based on the error signal e and the extraction signal efr. The differential signal generating unit 81 includes an adder 81*a*. The error signal e and the extraction signal efr are added by the adder 81*a*. As a result, the differential signal e0 is generated.

The adjustment filter updating unit 82 sequentially and adaptively updates the adjustment filter P by an adaptive algorithm (for example, an LMS (Least Mean Square) algorithm) so that the virtual error signal e1 is minimized.

The adjustment filter updating unit 82 includes a first adjustment filter coefficient updating unit 82*a* and a second adjustment filter coefficient updating unit 82*b*. The first adjustment filter coefficient updating unit 82*a* and the second adjustment filter coefficient updating unit 82*b* update the filter coefficient P0 and the filter coefficient P1 based on the following expressions. In the expressions, n denotes the number of time steps (time step number, n=0, 1, 2, . . . ). The signal processing unit 22 performs signal processing at predetermined periods. The time step indicates the length of each period. The time step number indicates how many periods (times) the signal processing is performed. In the expressions, $\mu 0_P$ and $\mu 1_P$ indicate step size parameters.

$$P0_{n+1}=P0_n-\mu 0_P\times e1_n\times xc_n$$

$$P1_{n+1}=P1_n-\mu 1_P\times e1_n\times xs_n$$

The secondary path filter updating unit 84 sequentially and adaptively updates the secondary path filter C^ by an adaptive algorithm (for example, LMS algorithm) so that the virtual error signal e1 is minimized.

The secondary path filter updating unit 84 includes a first secondary path filter coefficient updating unit 84*a* and a second secondary path filter coefficient updating unit 84*b*. The first secondary path filter coefficient updating unit 84*a* and the second secondary path filter coefficient updating unit 84*b* update the filter coefficient C0^ and the filter coefficient C1^ based on the following expressions. In the expressions, n denotes the time step number (n=0, 1, 2, . . . ), and $\mu 0_C$ and $\mu 1_C$ denotes step size parameters.

$$C0\hat{}_{n+1}=C0\hat{}_n-\mu 0_C\times e1_n\times u0_a_n$$

$$C1\hat{}_{n+1}=C1\hat{}_n-\mu 1_C\times e1_n\times u1_a_n$$

The extraction filter updating unit 85 sequentially and adaptively updates the extraction filter A using an adaptive algorithm (for example, an LMS algorithm) so that the differential signal e0 is minimized.

The extraction filter updating unit 85 includes a first extraction filter coefficient updating unit 85*a* and a second extraction filter coefficient updating unit 85*b*. The first extraction filter coefficient updating unit 85*a* and the second extraction filter coefficient updating unit 85*b* update the filter coefficient A0 and the filter coefficient A1 based on the following expressions. In the expressions, n denotes the time step number (n=0, 1, 2, . . . ), and $\mu 0_A$ and $\mu 1_A$ denote step size parameters.

$$A0_{n+1}=A0_n-\mu 0_A\times e0_n\times xc_n$$

$$A1_{n+1}=A1_n-\mu 1_A\times e0_n\times xs_n$$

[Setting of Feedback Filter FB]

The feedback filter setting unit 23 sets the feedback filter FB based on the secondary path filter C^. Hereinafter, setting of the feedback filter FB will be described.

A sensitivity function S, which is a transfer function of the error signal e and the noise d, is expressed by the following expression. The sensitivity function S indicates a reduction amount of noise d.

$$S=\frac{E}{D}=\frac{1}{1+C\cdot FB}$$

In the expression, E is a frequency characteristic of the error signal e, and D is a frequency characteristic of the noise d. When the secondary path filter C^ is substituted for the transfer characteristic C of the secondary path, the feedback filter FB is expressed by the following expression.

$$FB=\frac{1-S}{S}\cdot\frac{1}{C\hat{}}$$

The value of the sensitivity function S is predetermined. For example, when the acoustic pressure of drumming noise is reduced by approximately 6 dB, the sensitivity function S is approximately 0.5. When the sensitivity function S=0.5, the feedback filter setting unit 23 sets the filter coefficient FBP0 to a value obtained by normalizing the real part of 1/C^ with |1/C^|, and sets the filter coefficient FBP1 to a value obtained by normalizing the imaginary part of 1/C^ with |1/C^|.

The feedback filter setting unit 23 sets the gain FBG so as to gradually increase from the initial value to 1/|C^|. In a state in which the number of updating of the secondary path filter C^ is small and learning has not progressed, the value of 1/|C^| may rapidly increase. Therefore, by gradually increasing the gain FBG, it is possible to prevent a sound that the vehicle occupant feels uncomfortable from being output from the speaker 18 at a high sound pressure. Here, the initial value of the gain FBG is not 0, but is set to a value small enough to prevent the speaker 18 from emitting a sound that the vehicle occupant feels uncomfortable. This is because if the initial value of the gain FBG is set to 0, the learning of the secondary path filter C^ does not proceed much.

Further, the feedback filter setting unit 23 may set the gain FBG to have an initial value when the gain |C^| of the secondary path filter C^ is equal to or smaller than a predetermined value. Since the gain FBG is set to have the initial value until the learning of the secondary path filter C^ proceeds, it is possible to prevent the speaker 18 from emitting a sound that the vehicle occupant feels uncomfortable.

Further, when the amount of change in gain or the amount of change in phase due to the updating of the secondary path filter C^ is equal to or larger than a predetermined amount, the feedback filter setting unit 23 may return the gain FBG to the initial value. When the position of the microphone 32 changes, the transfer characteristic C of the secondary path may change greatly. In this case, the secondary path filter C^ is relearned. Therefore, by once setting the gain FBG to have an initial value and gradually increasing the gain FBG from the initial value to 1/|C^|, it is possible to prevent a sound that the vehicle occupant feels uncomfortable from being output from the speaker 18 at a high sound pressure.

[Operational Effects]

In the active noise control device 10 according to the present embodiment, the control signal generating unit 68 performs signal processing on the basic signal xc and the basic signal xs by the feedback filter FB and the extraction filter A. Thus, the control signal u0_*a* for controlling the speaker 18 is generated. Further, the feedback filter setting unit 23 sets the feedback filter FB based on the secondary path filter C^. Furthermore, the secondary path filter updating unit 84 sequentially and adaptively updates the secondary path filter C^. As a result, even when the transfer characteristic C of the secondary path changes, the secondary path filter C^ can follow the transfer characteristic C. As a result, the control signal u0_*a* is generated in accordance with the change in the transfer characteristic C, so that the sound pressure of drumming noise can be reduced.

Further, in the active noise control device 10 according to the present embodiment, the feedback filter setting unit 23 sets the feedback filter FB based on the secondary path filter C^ and a predetermined noise reduction amount (sensitivity function S). As a result, it is possible to reduce the amount of calculation when setting the feedback filter FB, and to suppress the load on the computation unit.

In the active noise control device 10 according to the present embodiment, the feedback filter setting unit 23 gradually increases the gain FBG of the feedback filter FB from a predetermined initial value to a gain 1/|C^|. As a result, it is possible to prevent a sound that the vehicle occupant feels uncomfortable from being output from the speaker 18 at a high sound pressure.

Further, in the active noise control device 10 according to the present embodiment, the feedback filter setting unit 23 sets the gain FBG of the feedback filter FB to a predetermined initial value when the gain |C^| of the secondary path filter C^ is equal to or smaller than a predetermined value. As a result, the gain FBG is set to have the initial value until the learning of the secondary path filter C^ proceeds, and thus it is possible to prevent the speaker 18 from emitting a sound that the vehicle occupant feels uncomfortable.

Further, in the active noise control device 10 according to the present embodiment, the feedback filter setting unit 23 sets the gain FBG of the feedback filter FB to have a predetermined initial value when the amount of change in the gain of the secondary path filter C^ or the amount of change in the phase of the secondary path filter C^ is equal to or greater than a predetermined amount. As a result, it is possible to prevent a sound that the vehicle occupant feels uncomfortable from being output from the speaker 18 at a high sound pressure.

Second Embodiment

In the active noise control device 10 according to the present embodiment, the configuration of the signal processing unit 22 is partially different from that of the signal processing unit 22 according to the first embodiment. In addition, a method of setting the feedback filter FB by the feedback filter setting unit 23 is different from the feedback filter setting unit 23 of the first embodiment.

[Configuration of Signal Processing Unit]

The signal processing unit 22 performs feedback signal processing. In the feedback signal processing, a control signal u0_*b* is generated. The control signal u0_*b* is a signal for causing the speaker 18 to output a canceling sound that cancels the drumming noise. The control signal u0_*b* is generated on the basis of an error signal e output from the microphone 32 provided at the control point. Hereinafter, a sound transfer path from the wheel 16 to the microphone 32 is referred to as a primary path, and a transfer characteristic of the primary path is denoted by H. Further, a sound transfer path from the speaker 18 to the microphone 32 is referred to as a secondary path, and a transfer characteristic of the secondary path is denoted by C.

Figure 4:
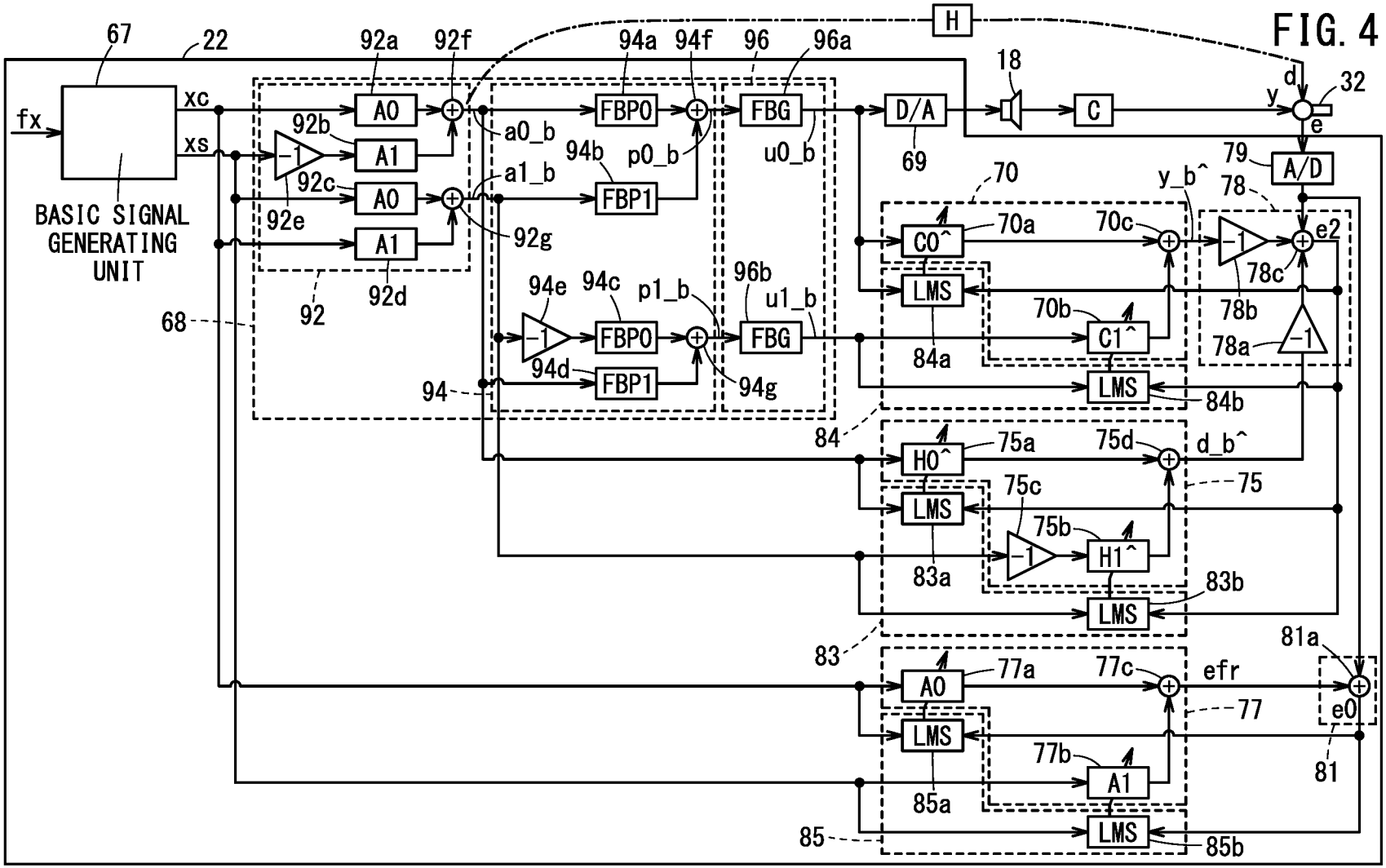
FIG. 4 is a control block diagram of a signal processing unit.

FIG. 4 is a control block diagram of the signal processing unit 22. The signal processing unit 22 includes a basic signal generating unit 67, a control signal generating unit 68, an estimated canceling sound signal generating unit 70, an estimated noise signal generating unit 75, an extraction signal generating unit 77, a virtual error signal generating unit 78, a differential signal generating unit 81, a primary path filter updating unit 83, a secondary path filter updating unit 84, and an extraction filter updating unit 85.

The basic signal generating unit 67 generates basic signals xc (=cos(2π×fx×t)) and xs (=sin(2π×fx×t)). The basic signal xc is a cosine signal of the control target frequency fx. The basic signal xs is a sine signal of the control target frequency fx. Here, t denotes time. The control target frequency fx is set near the peak frequency of the drumming noise in advance.

The control signal generating unit 68 performs signal processing on the basic signal xc and the basic signal xs by the feedback filter FB and the extraction filter A. Thus, the control signals u0_*b* and u1_*b* are generated. The control signal generating unit 68 includes a signal extraction unit 92, a phase adjusting unit 94, and a gain adjusting unit 96.

The feedback filter FB is indicated by FB=FBG (FBP0+iFBP1) using the gain FBG, a filter coefficient FBP0, and a filter coefficient FBP1. Here, i denotes an imaginary number. Further, $FBP0^2+FBP1^2=1$. The feedback filter FB is set by the feedback filter setting unit 23. The setting of the feedback filter FB will be described later in detail.

The signal extraction unit 92 performs signal processing on the basic signal xc and the basic signal xc by an extraction filter A. Thus, the extraction signals a0_*b* and a1_*b* are generated.

The signal extraction unit 92 includes a first extraction filter 92*a*, a second extraction filter 92*b*, a third extraction filter 92*c*, a fourth extraction filter 92*d*, an inverting amplifier 92*e*, an adder 92*f*, and an adder 92*g*.

The first extraction filter 92*a* has a filter coefficient A0. The second extraction filter 92*b* has a filter coefficient A1. The third extraction filter 92*c* has the filter coefficient A0. The fourth extraction filter 92*d* has the filter coefficient A1.

The second extraction filter 92*b* receives the basic signal −xs whose polarity is inverted by the inverting amplifier 92*e*. The basic signal xc whose amplitude is adjusted by the first extraction filter 92*a* and the basic signal −xs whose amplitude is adjusted by the second extraction filter 92*b* are added by the adder 92*f*. Thus, the extraction signal a0_*b* is generated.

The basic signal xs whose amplitude is adjusted by the third extraction filter 92*c* and the basic signal xc whose amplitude is adjusted by the fourth extraction filter 92*d* are added by the adder 92*g*. Thus, the extraction signal a1_*b* is generated.

The phase adjusting unit 94 performs signal processing on the extraction signals a0_*b* and a1_*b* by the phase adjustment filter FBP. As a result, the phase adjustment signals p0_*b* and p1_*b* are generated.

The phase adjusting unit 94 includes a first phase adjustment filter 94*a*, a second phase adjustment filter 94*b*, a third phase adjustment filter 94*c*, a fourth phase adjustment filter 94*d*, an inverting amplifier 94*e*, an adder 94*f*, and an adder 94*g*.

The first phase adjustment filter 94*a* has a filter coefficient FBP0. The second phase adjustment filter 94*b* has a filter coefficient FBP1. The third phase adjustment filter 94*c* has the filter coefficient FBP0. The fourth phase adjustment filter 94*d* has the filter coefficient FBP1.

The extraction signal a0_*b* whose amplitude is adjusted by the first phase adjustment filter 94*a* and the extraction signal a1_*b* whose amplitude is adjusted by the second phase adjustment filter 94*b* are added in the adder 94*f*. Thus, the phase adjustment signal p0_*b* is generated.

The third phase adjustment filter 94*c* receives the extraction signal −a1_*b* whose polarity is inverted by the inverting amplifier 94*e*. The extracted signal −a1_*b* whose amplitude is adjusted by the third phase adjustment filter 94*c* and the extraction signal a0_*b* whose amplitude is adjusted by the fourth phase adjustment filter 94*d* are added by the adder 94*g*. Thus, the phase adjustment signal p1_*b* is generated.

The gain adjusting unit 96 performs signal processing on the phase adjustment signals p0_*b* and p1_*b* by the gain filter FBG. Thus, the control signals u0_*b* and u1_*b* are generated.

The gain adjusting unit 96 includes a first gain adjustment filter 96*a* and a second gain adjustment filter 96*b*. The first gain adjustment filter 96*a* has a gain FBG. The second gain adjustment filter 96*b* has the gain FBG.

The amplitude of the phase adjustment signal p0_*b* is adjusted by the first gain adjustment filter 96*a*. Thus, the control signal u0_*b* is generated. The amplitude of the phase adjustment signal p1_*b* is adjusted by the second gain adjustment filter 96*b*. Thus, the control signal u1_*b* is generated. The control signal u0_*b* is converted into an analog signal by the digital-to-analog converter 69 and output to the speaker 18.

In the estimated canceling sound signal generating unit 70 described below, the control signal u0_*b* is used as a real component, and the control signal u1_*b* is used as an imaginary component.

The estimated canceling sound signal generating unit 70 performs signal processing on the control signals u0_*b* and u1_*b* by a secondary path filter C^. Thus, the estimated canceling sound signal y_b^ is generated.

In the estimated canceling sound signal generating unit 70, an adaptive notch filter (for example, a SAN filter) is used as the secondary path filter C^. The secondary path filter C^ is updated by the secondary path filter updating unit 84, which will be described later, so as to converge on a sound transfer characteristic C of the secondary path. The secondary path filter C^ is indicated by C^=C0^+iC1^ using the filter coefficients C0^ and C1^. Here, i denotes an imaginary number.

The estimated canceling sound signal generating unit 70 includes a first secondary path filter 70*a*, a second secondary path filter 70*b*, and an adder 70*c*.

The first secondary path filter 70*a* has a filter coefficient C0^. The second secondary path filter 70*b* has a filter coefficient C1^. The control signal u0_*b* whose amplitude is adjusted by the first secondary path filter 70*a* and the control signal u1_*b* whose amplitude is adjusted by the second secondary path filter 70*b* are added by the adder 70*c*. Thus, the estimated canceling sound signal y_b^ is generated.

The estimated noise signal generating unit 75 performs signal processing on the extraction signals a0_*b* and a1_*b* by a primary path filter H^. As a result, an estimated noise signal d_b^ is generated.

In the estimated noise signal generating unit 75, an adaptive notch filter (for example, a SAN filter) is used as the primary path filter H^. The primary path filter H^ is updated by the primary path filter updating unit 83, which will be described later, so as to converge on a sound transfer characteristic H of the primary path. The primary path filter H^ is indicated by H^=H0^+iH1^ using the filter coefficients H0^ and H1^. Here, i denotes an imaginary number.

The estimated noise signal generating unit 75 includes a first primary path filter 75*a*, a second primary path filter 75*b*, an inverting amplifier 75*c*, and an adder 75*d*. The first primary path filter 75*a* has a filter coefficient H0^. The second primary path filter 75*b* has a filter coefficients H1^.

The second primary path filter 75*b* receives the extraction signal −a1_*b* whose polarity is inverted by the inverting amplifier 75*c*. The extracted signal a0_*b* whose amplitude is adjusted by the first primary path filter 75*a* and the extraction signal −a1_*b* whose amplitude is adjusted by the second primary path filter 75*b* are added by the adder 75*d*. As a result, an estimated noise signal d_b^ is generated.

The extraction signal generating unit 77 performs signal processing on the basic signal xc and the basic signal xs by an extraction filter A. Thus, an extraction signal efr is generated. In the extraction signal generating unit 77, an adaptive notch filter (for example, a SAN filter) is used as the extraction filter A. The extraction filter A is updated and optimized by the extraction filter updating unit 85 described later. The extraction filter A has filter coefficients A0 and A1 which match the basic signals xc and xs to the amplitude and phase of the drumming noise.

The extraction signal generating unit 77 includes a first extraction filter 77*a*, a second extraction filter 77*b*, and an adder 77*c*. The first extraction filter 77*a* has the filter coefficient A0. The second extraction filter 77*b* has the filter coefficient A1.

The basic signal xc whose amplitude is adjusted by the first extraction filter 77*a* and the basic signal xs whose amplitude is adjusted by the second extraction filter 77*b* are added by the adder 77*c*. Thus, an extraction signal efr is generated.

The virtual error signal generating unit 78 generates a virtual error signal e2 based on the error signal e, the estimated noise signal d_b^, and the estimated canceling sound signal y_b^. The virtual error signal generating unit 78 includes an inverting amplifier 78*a*, an inverting amplifier 78*b*, and an adder 78*c*.

The error signal e converted into a digital signal by an analog-to-digital converter 79, the estimated noise signal −d_b^ whose polarity is inverted by the inverting amplifier 78*a*, and the estimated canceling sound signal −y_b^ whose polarity is inverted by the inverting amplifier 78*b* is added by the adder 78*c*. Thus, the virtual error signal e2 is generated.

The differential signal generating unit 81 generates a differential signal e0 based on the error signal e and the extraction signal efr. The differential signal generating unit 81 includes an adder 81*a*. The error signal e and the extraction signal efr are added by the adder 81*a* to generate the differential signal e0.

The primary path filter updating unit 83 sequentially and adaptively updates the primary path filter H^ by an adaptive algorithm (for example, an LMS algorithm) so that the virtual error signal e2 is minimized.

The primary path filter updating unit 83 includes a first primary path filter coefficient updating unit 83*a* and a second primary path filter coefficient updating unit 83*b*. The first primary path filter coefficient updating unit 83*a* and the second primary path filter coefficient updating unit 83*b* update the filter coefficient H0^ and the filter coefficient H1^ based on the following expressions. In the expressions, n denotes the time step number (n=0, 1, 2, . . . ), and $\mu 0_H$ and $\mu 1_H$ denote step size parameters.

$$H0^{\wedge}_{n+1}=H0^{\wedge}_{n}-\mu 0_H \times e2_n \times a0_b_n$$

$$H1^{\wedge}_{n+1}=H1^{\wedge}_{n}-\mu 1_H \times e2_n \times a1_b_n$$

The secondary path filter updating unit 84 sequentially and adaptively updates the secondary path filter C^ by an adaptive algorithm (for example, LMS algorithm) so that the virtual error signal e2 is minimized.

The secondary path filter updating unit 84 includes a first secondary path filter coefficient updating unit 84*a* and a second secondary path filter coefficient updating unit 84*b*. The first secondary path filter coefficient updating unit 84*a* and the second secondary path filter coefficient updating unit 84*b* update the filter coefficient C0^ and the filter coefficient C1^ based on the following expressions. In the expressions, n denotes the time step number (n=0, 1, 2, . . . ), and $\mu 0_C$ and $\mu 1_C$ denotes step size parameters.

$$C0^{\wedge}_{n+1}=C0^{\wedge}_{n}-\mu 0_C \times e2_n \times u0_b_n$$

$$C1^{\wedge}_{n+1}=C1^{\wedge}_{n}-\mu 1_C \times e2_n \times u1_b_n$$

The extraction filter updating unit 85 sequentially and adaptively updates the extraction filter A using an adaptive algorithm (for example, an LMS algorithm) so that the differential signal e0 is minimized.

The extraction filter updating unit 85 includes a first extraction filter coefficient updating unit 85*a* and a second extraction filter coefficient updating unit 85*b*. The first extraction filter coefficient updating unit 85*a* and the second extraction filter coefficient updating unit 85*b* update the filter coefficient A0 and the filter coefficient A1 based on the following expressions. In the expressions, n denotes the time step number (n=0, 1, 2, . . . ), and $\mu 0_A$ and $\mu 1_A$ denote step size parameters.

$$A0_{n+1}=A0_n-\mu 0_A \times e0_n \times xc_n$$

$$A1_{n+1}=A1_n-\mu 1_A \times e0_n \times xs_n$$

[Setting of Feedback Filter FB]

The feedback filter setting unit 23 sets the feedback filter FB based on the primary path filter H^ and the secondary path filter C^. Hereinafter, setting of the feedback filter FB will be described.

When the primary path filter H^ converges on the transfer characteristic H of the primary path and the secondary path filter C^ converges on the transfer characteristic C of the secondary path, the primary path filter H^ is expressed by the following expression.

$$H^{\wedge}=C^{\wedge}FB$$

When this expression is solved for the feedback filter FB, the feedback filter FB is expressed by the following expression.

$$FB=H^{\wedge}/C^{\wedge}$$

The feedback filter setting unit 23 sets the filter coefficient FBP0 to a value obtained by normalizing the real part of $\hat{H}/\hat{C}$ with $|\hat{H}/\hat{C}|$. The feedback filter setting unit 23 sets the filter coefficient FBP1 to a value obtained by normalizing the imaginary part of $\hat{H}/\hat{C}$ with $|\hat{H}/\hat{C}|$.

The feedback filter setting unit 23 gradually increases the gain FBG from the initial value to $|1/\hat{C}|$. In a state where the number of updating of the primary path filter $\hat{H}$ and the secondary path filter $\hat{C}$ is small and learning has not progressed, the value of $|1/\hat{C}|$ may rapidly increase. Therefore, by gradually increasing the gain FBG, it is possible to prevent a sound that the vehicle occupant feels uncomfortable from being output from the speaker 18 at a high sound pressure. Here, the initial value of the gain FBG is not 0, but is set to a value small enough to prevent the speaker 18 from emitting a sound that the vehicle occupant feels uncomfortable. This is because if the initial value of the gain FBG is set to 0, the learning of the secondary path filter $\hat{C}$ does not proceed much.

The feedback filter setting unit 23 may set the gain FBG to an initial value when the gain $|\hat{H}|$ of the primary path filter $\hat{H}$ or the gain $|\hat{C}|$ of the secondary path filter $\hat{C}$ is equal to or less than a predetermined value. Since the gain FBG is set to the initial value until the learning of the primary path filter $\hat{H}$ and the secondary path filter $\hat{C}$ proceeds, it is possible to prevent the speaker 18 from emitting a sound that the vehicle occupant feels uncomfortable.

When at least one of the following four conditions is satisfied, the feedback filter setting unit 23 may return the gain FBG to the initial value. The four conditions are the following (1) to (4).

(1) The amount of change in gain due to the updating of the primary path filter $\hat{H}$ is equal to or greater than a predetermined amount.

(2) The amount of change in phase due to the updating of the primary path filter $\hat{H}$ is equal to or greater than a predetermined amount.

(3) The amount of change in gain due to the updating of the secondary path filter $\hat{C}$ is equal to or greater than a predetermined amount.

(4) The amount of change in phase due to the updating of the secondary path filter $\hat{C}$ is equal to or greater than a predetermined amount.

When the position of the microphone 32 changes, the transfer characteristic C of the secondary path may change greatly. In this case, the secondary path filter $\hat{C}$ is relearned. Then, by once setting the gain FBG to have an initial value and gradually increasing the gain FBG from the initial value to $|\hat{H}/\hat{C}|$, it is possible to prevent a sound that the vehicle occupant feels uncomfortable from being output from the speaker 18 at a high sound pressure.

[Advantageous Effects]

In the active noise control device 10 according to the present embodiment, the control signal generating unit 68 performs signal processing on the basic signal xc and the basic signal xs by the feedback filter FB and the extraction filter A. Thus, the control signal u0_*b* for controlling the speaker 18 is generated. Further, the feedback filter setting unit 23 sets the feedback filter FB based on the secondary path filter $\hat{C}$. Furthermore, the secondary path filter updating unit 84 sequentially and adaptively updates the secondary path filter $\hat{C}$. As a result, even when the transfer characteristic C of the secondary path changes, the secondary path filter $\hat{C}$ can follow the transfer characteristic C. As a result, the control signal u0_*b* can be generated in accordance with the change in the transfer characteristic C, so that the sound pressure of drumming noise can be reduced.

In the active noise control device 10 according to the present embodiment, the feedback filter setting unit 23 sets the feedback filter FB based on the primary path filter $\hat{H}$ and the secondary path filter $\hat{C}$. As a result, it is possible to reduce the amount of calculation when setting the feedback filter FB, and to suppress the load on the computation unit.

[Technical Concepts Obtained from Embodiments]

A description will be given below concerning technical concepts that are capable of being grasped from the above-described embodiments.

The active noise control device (10) controls the speaker (18) based on a component of a frequency band around a predetermined frequency of an error signal output from the detector (32) that detects, at a control point, a synthetic sound of a noise transmitted from a vibration source and a canceling sound output from the speaker to cancel the noise, and includes the basic signal generating unit (67) configured to generate a basic signal corresponding to the predetermined frequency, the control signal generating unit (68) configured to perform signal processing on the basic signal by a feedback filter and an extraction filter, which is an adaptive notch filter, to generate a control signal that controls the speaker, the estimated canceling sound signal generating unit (70) configured to perform signal processing on the control signal by a secondary path filter, which is an adaptive notch filter, to generate an estimated canceling sound signal, the extraction signal generating unit (77) configured to perform signal processing on the basic signal by the extraction filter to generate an extraction signal, the virtual error signal generating unit (78) configured to generate a virtual error signal from the error signal and the estimated canceling sound signal, the differential signal generating unit (81) configured to generate a differential signal from the error signal and the extraction signal, the secondary path filter updating unit (84) configured to update sequentially and adaptively the secondary path filter based on the control signal and the virtual error signal in a manner that a magnitude of the virtual error signal is minimized, the extraction filter updating unit (85) configured to update sequentially and adaptively the extraction filter based on the basic signal and the differential signal in a manner that a magnitude of the differential signal is minimized, and the feedback filter setting unit (23) configured to set the feedback filter based on the secondary path filter.

In the above active noise control device, the feedback filter setting unit may increase a gain of the feedback filter gradually from a predetermined initial value.

In the above active noise control device, the feedback filter setting unit may set a gain of the feedback filter to a predetermined initial value when a gain of the secondary path filter is equal to or less than a predetermined value.

In the above active noise control device, the feedback filter setting unit may set a gain of the feedback filter to a predetermined initial value when an amount of change in gain or an amount of change in phase of the secondary path filter is equal to or greater than a predetermined amount.

In the above active noise control device, the feedback filter setting unit may set the feedback filter based on the secondary path filter and a predetermined noise reduction amount.

The active noise control device may further include the estimated noise signal generating unit (75) configured to perform signal processing on the extraction signal by a primary path filter, which is an adaptive notch filter, to generate an estimated noise signal, and the primary path filter updating unit (83) configured to update the primary path filter based on the basic signal and the virtual error signal in a manner that the magnitude of the virtual error signal is minimized, wherein the virtual error signal generating unit may generate the virtual error signal from the error signal, the estimated noise signal, and the estimated canceling sound signal, and the feedback filter setting unit may calculate the feedback filter from the primary path filter and the secondary path filter.

The present invention is not particularly limited to the embodiments described above, and various modifications are possible without departing from the essence and gist of the present invention.

What is claimed is:

1. An active noise control device that controls a speaker based on a component of a frequency band around a predetermined frequency of an error signal output from a detector that detects, at a control point, a synthetic sound of a noise transmitted from a vibration source and a canceling sound output from the speaker to cancel the noise, the active noise control device comprising one or more processors that execute computer-executable instructions stored in a memory, wherein the one or more processors execute the computer-executable instructions to cause the active noise control device to:

generate a basic signal corresponding to the predetermined frequency;

perform signal processing on the basic signal by a feedback filter and an extraction filter, which is an adaptive notch filter, to generate a control signal that controls the speaker;

perform signal processing on the control signal by a secondary path filter, which is an adaptive notch filter, to generate an estimated canceling sound signal;

perform signal processing on the basic signal by the extraction filter to generate an extraction signal;

generate a virtual error signal from the error signal and the estimated canceling sound signal;

generate a differential signal from the error signal and the extraction signal;

update sequentially and adaptively the secondary path filter based on the control signal and the virtual error signal in a manner that a magnitude of the virtual error signal is minimized;

update sequentially and adaptively the extraction filter based on the basic signal and the differential signal in a manner that a magnitude of the differential signal is minimized; and set the feedback filter based on the secondary path filter.

2. The active noise control device according to claim 1, wherein the one or more processors cause the active noise control device to increase a gain of the feedback filter gradually from a predetermined initial value.

3. The active noise control device according to claim 1, wherein the one or more processors cause the active noise control device to set a gain of the feedback filter to a predetermined initial value when a gain of the secondary path filter is equal to or less than a predetermined value.

4. The active noise control device according to claim 1, wherein the one or more processors cause the active noise control device to set a gain of the feedback filter to a predetermined initial value when an amount of change in gain or an amount of change in phase of the secondary path filter is equal to or greater than a predetermined amount.

5. The active noise control device according to claim 1, wherein the one or more processors cause the active noise control device to set the feedback filter based on the secondary path filter and a predetermined noise reduction amount.

6. The active noise control device according to claim 1, wherein the one or more processors cause the active noise control device to:

perform signal processing on the extraction signal by a primary path filter, which is an adaptive notch filter, to generate an estimated noise signal;

update the primary path filter based on the basic signal and the virtual error signal in a manner that the magnitude of the virtual error signal is minimized;

generate the virtual error signal from the error signal, the estimated noise signal, and the estimated canceling sound signal; and calculate the feedback filter from the primary path filter and the secondary path filter.

* * * * *